US008105217B2

(12) United States Patent
Alessandri et al.

(10) Patent No.: US 8,105,217 B2
(45) Date of Patent: Jan. 31, 2012

(54) GRIP ELEMENT FOR EXERCISE MACHINE

(75) Inventors: Nerio Alessandri, Longiano (IT); Luca Benini, Cannuzzo di Cervia (IT); Roberto Malaguti, Forli' (IT); Paolo Pieri, Cesena (IT); Marco Casadei, Montecolombo (IT)

(73) Assignee: Technogym S.p.A., Gambettola (IT)

( * ) Notice: Subject to any disclaimer, the term of this patent is extended or adjusted under 35 U.S.C. 154(b) by 54 days.

(21) Appl. No.: 12/392,690

(22) Filed: Feb. 25, 2009

(65) Prior Publication Data

US 2009/0215595 A1 Aug. 27, 2009

(30) Foreign Application Priority Data

Feb. 27, 2008 (IT) ..... BO2008A0127

(51) Int. Cl.
*A63B 23/16* (2006.01)
*A63B 71/00* (2006.01)

(52) U.S. Cl. ..... 482/139; 482/49; 482/908

(58) Field of Classification Search ..... 482/44, 482/49, 139, 91, 47
See application file for complete search history.

(56) References Cited

U.S. PATENT DOCUMENTS 1,610,324 A * 12/1926 Roche et al. ..... 482/129
1,944,603 A * 1/1934 Hecker ..... 24/134 R
2,448,384 A * 8/1948 Meinzinger ..... 188/65.1
3,979,797 A * 9/1976 Stember ..... 24/134 R
4,023,808 A * 5/1977 Hebert ..... 482/126
4,026,549 A * 5/1977 Gunn ..... 482/124
4,059,265 A 11/1977 Wieder et al.
4,250,171 A * 2/1981 Carter et al. ..... 514/521
4,540,173 A * 9/1985 Hopkins, Jr. ..... 482/124
4,852,874 A * 8/1989 Sleichter et al. ..... 482/122
4,911,439 A 3/1990 Kuhl
5,234,395 A 8/1993 Miller et al.
5,372,557 A * 12/1994 Ostigny ..... 482/49
5,514,059 A * 5/1996 Romney ..... 482/124
5,518,481 A * 5/1996 Darkwah ..... 482/126
5,624,362 A * 4/1997 Wilson ..... 482/139
5,643,159 A * 7/1997 Iavarone ..... 482/125
5,735,776 A * 4/1998 Swezey et al. ..... 482/91
5,806,902 A 9/1998 Kliest
6,860,841 B1 3/2005 Mortorano
2004/0009858 A1 1/2004 Tamaribuchi

FOREIGN PATENT DOCUMENTS

WO 2006034270 A 3/2006

* cited by examiner

*Primary Examiner* — Loan Thanh
*Assistant Examiner* — Sandhara Ganesan
(74) *Attorney, Agent, or Firm* — Pearne & Gordon LLP

(57) ABSTRACT

A grip element for an exercise machine, comprising at least a substantially tubular handgrip (2), forming at least one outer surface (3) to be gripped by the user's hand while performing exercises to develop muscles or the like, and having at least one substantially longitudinal through-channel (4) in which there will engage at least one flexible cable (5) connected to at least one resistant load of at least one exercise machine, the grip element being characterized in that said handgrip (2) comprises means (6) for selective locking of the grip element in any position along the cable (5), the locking means being designed to prevent the handgrip (2) from sliding relative to the cable (5) when the grip element is manually translated and/or rotated in any direction in space.

15 Claims, 2 Drawing Sheets

GRIP ELEMENT FOR EXERCISE MACHINE

BACKGROUND OF THE INVENTION

The present invention relates to a grip element for performing an exercise on an exercise machine. In particular, the grip element is connected to a resistant load of an exercise machine for training and developing muscular strength. In more detail, the grip element is connected to a flexible cable which is wound around a plurality of pulleys rotatably supported by the frame of an exercise machine and connected to a resistant load.

Prior art grip elements in such types of strength machines consist of a cylindrical element prepared so that it can be easily and comfortably gripped by a user to perform the exercise by operating the element itself against the resistance of a resistant load. The cylindrical element usually has an axial cavity through which the cable passes in such a way that it can slide freely. Moving the grip element with a purely axial movement along the cable, the resistant load connected to the cable is not moved, since the cylindrical element simply slides along the cable which remains stationary. Vice versa, moving the grip element with a movement purely transversal to the axis of the cylindrical element, the resistant load is moved since the cylindrical element pulls the cable with it against the resistance of the load. In such strength machines complex movements are usually performed, that is to say, movements of the grip element which comprise both axial and transversal components. In this case, when the exercise is being performed, there is always relative sliding between the cylindrical element and the cable during which the user perceives a discontinuity and a loss of fluidity in the performance of the movement. It should be noticed that said grip element operating characteristic described above is very negative and such that it compromises the correct performance of the exercise.

SUMMARY OF THE INVENTION

The present invention therefore has for a technical purpose to overcome the above-mentioned disadvantages by providing a grip element for an exercise machine which allows the user, when performing any movement in space, whether it is simple or complex, to pull the machine cable so as to lift a weight without there being any relative sliding between the grip element and the cable, so that the user can perform the exercise in a correct and comfortable way.

Within said technical purpose, the present invention has for an aim to provide a grip element for an exercise machine which, in any machine operating and use condition in which the grip element remains stationary in any inactive position, allows the cable to slide freely in its axial cavity without applying any resistant action.

Yet another aim of the present invention is to provide a grip element for an exercise machine which has a simple structure, is easy to make in practice, operates safely and effectively and is relatively inexpensive.

Accordingly, said purpose and aims are achieved by the present grip element for an exercise machine, comprising at least a substantially tubular handgrip, forming at least one outer surface to be gripped by the user's hand while performing exercises to develop muscles or the like, the handgrip having at least one substantially longitudinal through-channel in which there will engage at least one flexible cable connected to at least one resistant load of at least one exercise machine, characterized in that said handgrip comprises means for selective locking of the grip element in any position along the cable, these locking means being designed to prevent the handgrip from sliding relative to the cable when the grip element is manually translated and/or rotated in any direction in space.

BRIEF DESCRIPTION OF THE DRAWINGS

The technical features of the invention, with reference to the above aims, are clearly described in the claims below, and its advantages are more apparent from the detailed description which follows, with reference to the accompanying drawings which illustrate preferred example embodiments of the invention provided merely by way of example without restricting the scope of the inventive concept, and in which:

DESCRIPTION OF THE PREFERRED EMBODIMENTS

Figure 1:
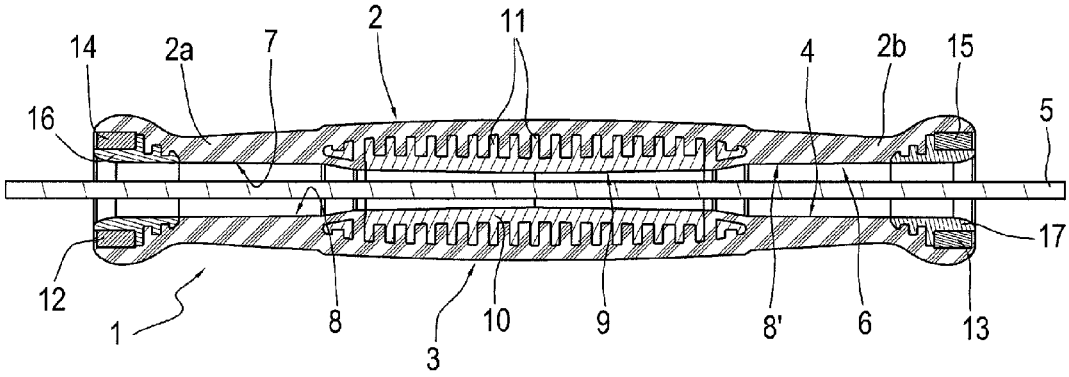
FIG. 1 illustrates a cross-section of a first example embodiment of a grip element for an exercise machine in accordance with the invention.

With reference to the accompanying drawings, and in particular with reference to FIG. 1, the numeral 1 denotes a first preferred example embodiment of a grip element for an exercise machine in accordance with the invention.

The grip element is of the type usually used on exercise machines in gymnasiums or the like to perform exercises for developing the user's muscles, which normally consist of repeatedly lifting a load, for example a weight stack. In more detail, the grip element is of the type which slides along the above-mentioned cable, to perform exercises which require positioning of the element at various points of the cable (for example, at various heights above the ground). To perform such exercises correctly, or to restore exercise machine operation even after performing the exercise, or for other reasons which do not form the subject matter of this invention, it is advantageous that the grip element does not slide along the cable when the exercise is being performed. At the same time, it is also appropriate and advantageous that the cable can slide freely relative to the grip element in all exercise machine operating conditions in which the grip element is not used and is left inactive. Said result is effectively achieved by the grip element disclosed, as described below.

The grip element 1 comprises a handgrip, labeled 2 as a whole, which is substantially tubular, forming a first end 2*a*, a second end 2*b* and an outer surface 3 to be gripped by the user's hand when performing exercises to develop muscles or the like, for example lifting weights.

The handgrip 2 has a longitudinal through-channel 4 in which there engages, in such a way that it slides freely, a flexible and in extensible cable 5, for example made of steel, connected to at least one resistant load present in the exercise machine, not illustrated in the accompanying drawings, for example consisting of a typical weight stack, of the known type and not forming the subject matter of the present invention.

According to the invention, the handgrip 2 advantageously comprises means, labeled 6 as a whole, for selective locking of the grip element along the cable 5: after manual actions applied by the user on the grip element in any direction in space, said selective locking means 6 prevent the handgrip 2 from sliding relative to the cable 5. In other words, the selective locking means 6 allow the user to pull the cable 5 in the desired direction and with the desired travel, without any relative sliding, so as to transmit the tractive force he applies to the resistant load, thus lifting it. Said manual actions may, in practice, consist of pulling the cable 5 in a direction at a right angle to the cable, or along other directions which do not coincide with the axis of the cable 5, or even actions consisting of rotation or rotation—translation of the grip element 1 whose effect is, in any case, to pull the cable 5 in any direction.

The selective locking means 6 appropriately comprise at least one contact surface 7, described in more detail below, in the handgrip 2 through-channel 4, which, after the manual action applied by the user on the grip element 1, adheres by friction to the outer surface of the cable 5, preventing the cable from sliding freely relative to the handgrip 2. Said contact surface 7 may be substantially at one of the openings of the through-channel 4, or at both of the openings.

More precisely, to allow the user to achieve the desired technical result in any direction in space in which he moves the grip element to lift the weight, that is to say, to guarantee that the grip element selective locking function works on both sides, the contact surface 7 advantageously consists of a first portion 8 and a second portion 8' which are separate, located at the opposite openings of the through-channel 4 and therefore respectively at the first end 2*a* and at the second end 2*b* of the handgrip 2.

The through-channel 4 conveniently has a substantially cylindrical rigid middle segment 9. Said middle segment 9 is preferably formed by a sleeve 10, for example made of plastic or the like, its outer lateral surface having equidistantly distributed tabs 11 designed to allow locked coupling with the handgrip 2. The presence of the sleeve 10 gives the central portion of the handgrip 2 the necessary stiffness, thus providing two fundamental technical results: comfortable gripping of the grip element when performing the exercise and free sliding of the cable 5 through the grip element in all exercise machine operating conditions in which the grip element is not actively used, that is to say, is left in an inactive position.

Advantageously, the handgrip 2 is made of substantially elastically flexible material, for example natural or synthetic rubber. In practice, the use of an elastically flexible material allows the first end 2*a* and/or the second end 2*b* to bend with the cable 5, thus promoting adhesion of the first portion 8 of the contact surface 7 and the second portion 8' of the contact surface 7 to the outer surface of the cable 5, and locking the cable relative to the grip element when exercises are being performed. Obviously, the extent of the bending of the first end 2*a* and of the second end 2*b* of the handgrip 2, and therefore the effectiveness of their adhesion to the cable 5, is substantially directly proportional to the resistant load connected to the cable 5, that is to say, to the weight to be lifted, considering that the movement will be performed using the grip element.

The handgrip 2 preferably has, respectively at the first end 2*a* and at the second end 2*b*, a first recess 12 and a second recess 13 which mirror each other, in which there are mounted respectively a first magnet 14 and a second magnet 15, having a substantially annual shape and designed to allow, where necessary, removable retention of the grip element in predetermined positions of the exercise machine. The first magnet 14 and the second magnet 15 are preferably fixed respectively to the first end 2*a* and to the second end 2*b* of the handgrip 2 by means of a first annular insert 16 and a second annular insert 17.

The method of using the grip element 1 in accordance with the invention is intuitive. Gripping the handgrip 2 with one hand, and performing a movement consisting of a translation, a rotation—translation or a rotation in any direction in space not coinciding with the axis of the cable 5 in the home position, the bending of the cable 5 causes consequent bending of the first end 2*a* and/or of the second end 2*b* of the handgrip 2 and adhesion of the first portion 8 of the contact surface 7 and/or of the second portion 8' of the contact surface 7, by friction, to the outer surface of the cable 5, thus preventing the cable 5 from sliding relative to the handgrip 2. This allows the user to transmit the force he applied, without slipping, to the resistant load, lifting the load and so performing exercises to develop muscles. At the same time, in all exercise machine operating conditions in which the grip element is not gripped and pulled in space by the user, but remains in an inactive position (for example retained by the first magnet 14 or by the second magnet 15), the cable 5 can slide freely through the grip element so that, for example, it can be used by other grip elements present on the machine, or by other equipment, or even in other ways.

Therefore, as indicated the invention achieves the preset aims.

The grip element for an exercise machine disclosed allows the machine user to perform movements in space, pulling the cable without any relative sliding between the grip element and the cable, therefore, in an effective and safe way. At the same time, the grip element disclosed guarantees, if left stationary in an inactive position, that the cable can slide freely inside it without encountering any friction resistance, for example being pulled by other grip elements present on the exercise machine.

The invention described above may be modified and adapted in several ways without thereby departing from the scope of the inventive concept.

Figure 2:
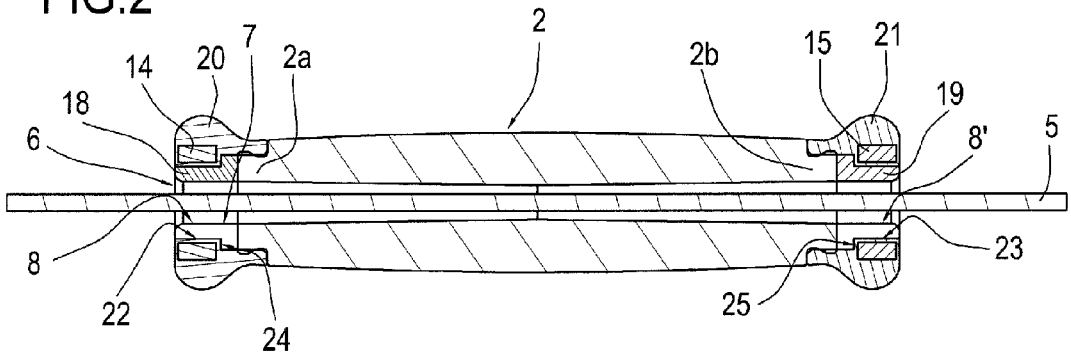
FIG. 2 is a cross-section of a second example embodiment of the grip element in accordance with the invention.

FIG. 2 shows a second example embodiment of the grip element for an exercise machine in accordance with the invention. In FIG. 2, for convenience and easy understanding, the elements corresponding to those described in the first example embodiment are labeled with the same reference characters.

In this second example embodiment the handgrip 2, having a substantially tubular shape, is made of a rigid material (for example plastic or the like). As described in more detail below, the through-channel 4 contact surface 7 is formed by at least a first end ring 18, made of substantially elastically flexible material such as rubber or the like, rendered integral with the handgrip 2 at one of the ends 2*a*, 2*b* of the handgrip. The elasticity of said first end ring 18 allows, as explained above, in practice, contact with a high friction coefficient between the grip element 1 and the cable 5, which prevents their relative sliding.

Again in this second example embodiment, to guarantee that the grip element 1 selective locking function works on both sides, there is a first portion 8 of the contact surface 7 and a second portion 8' of the contact surface 7 of the through-channel 4. Advantageously these are formed respectively by a first end ring 18 and by a second end ring 19, made of substantially elastically flexible material such as rubber or the like, and integral respectively with the first end 2*a* and with the second end 2*b* of the handgrip 2.

The first end ring 18 and the second end ring 19 are rigidly connected to the first end 2*a* and to the second end 2*b* of the handgrip 2 by a first casing 20 and a second casing 21, the casings fixed to the handgrip 2 for example by means of screw connections, respectively having a first hole 22 and a second hole 23 for the passage of the cable 5, and respectively forming a first shoulder 24 and a second shoulder 25 for retaining the first end ring 18 and the second end ring 19.

Appropriately, the first end ring 18 and the second end ring 19 are both of the interchangeable type, that is to say, they can be substituted, if their state of wear compromises their operation, by simply removing the first casing 20 and the second casing 21. The first magnet 14 and the second magnet 15 may be incorporated respectively in the first casing 20 and in the second casing 21.

This second example embodiment is advantageous in situations in which the method of performing the exercise requires the handgrip 2 to remain, in practice, substantially rigid at least in its central portion (for example, if the loads are very high), without inducing in the user's hand a sensation of instability and bending which may not be very comfortable.

Figure 3:
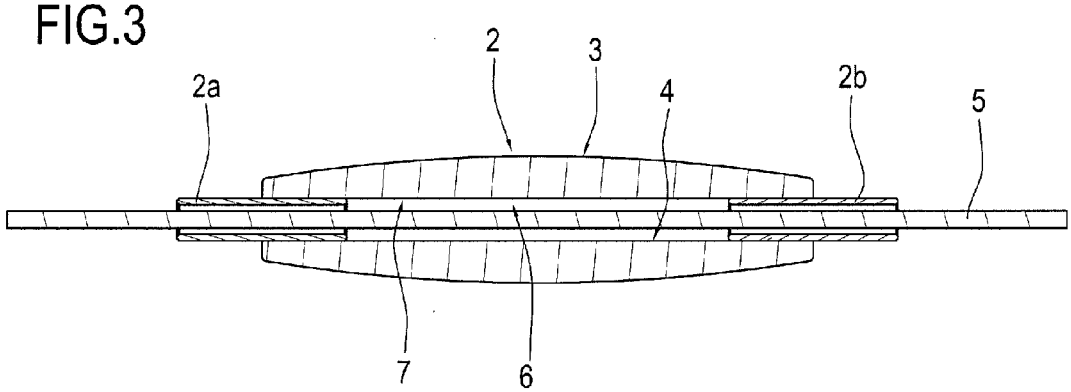
FIG. 3 is a cross-section of a third example embodiment of the grip element in accordance with the invention.

FIG. 3 shows a third example embodiment of the grip element for an exercise machine in accordance with the invention. In FIG. 3, for convenience and easy understanding, the elements corresponding to those described in the previous example embodiments are labeled with the same reference characters.

In this third example embodiment the contact surface 7 is appropriately formed in a central portion of the through-channel 4. For this purpose, the handgrip 2 is made of substantially elastically flexible material, for example rubber or the like. The first end 2*a* and the second end 2*b* of the handgrip 2, opposite each other, are rigid and substantially tubular, being designed to allow the cable 5 to slide freely along the through-channel 4 in the absence of manual actions on the grip element by the user. In practice, the first end 2*a* and the second end 2*b* are advantageously made of two pieces of metal tube having an internal diameter slightly greater than the external diameter of the cable 5. This embodiment is particularly effective for guaranteeing free sliding of the cable 5 in all machine operating conditions in which the grip element 1 is not actively used by the user, but instead is left inactive in some machine positions. In contrast, when the user grips the grip element 1 to perform an exercise, the pulling action applied on the cable causes the central portion of the handgrip 2 to bend, said bending causing the contact surface 7 formed in the through-channel 4 to adhere to the outer surface of the cable 5. In this way, friction prevents any relative sliding between the cable 5 and the grip element. This third example embodiment allows the central portion of the handgrip 2 to be given particular softness and pliability, which may be advantageous when performing particular exercises using a low load.

Figure 4:
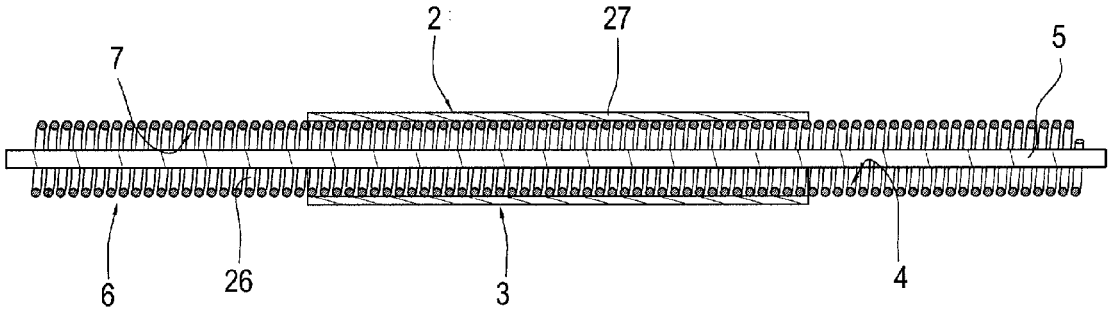
FIG. 4 is a cross-section of a fourth example embodiment of the grip element in accordance with the invention.

FIG. 4 shows a fourth example embodiment of the grip element in accordance with the invention. In FIG. 4, for convenience and easy understanding, the elements corresponding to those described in the previous example embodiments are labeled with the same reference characters.

In this fourth example embodiment the handgrip 2 comprises at least one cylindrical helical spring 26 and a portion of rigid tube 27 to be gripped by the user's hand, integral in such a way that it is concentric with the spring 26 at the centre. Appropriately, the contact surface 7 is formed by the inner surface of the spring 26, and in particular by the end portions. After a pulling action on the cable 5 in any direction in space, not coinciding with the axis of the cable 5, the spring 26 bends at the ends in such a way that the contact surface 7 can adhere by friction to the cable 5, preventing the cable from sliding relative to the handgrip 2. This example embodiment has the advantage of not requiring any maintenance during the life of the exercise machine, since there are no parts subject to obvious wear caused by contact with the cable 5.

Figure 5:
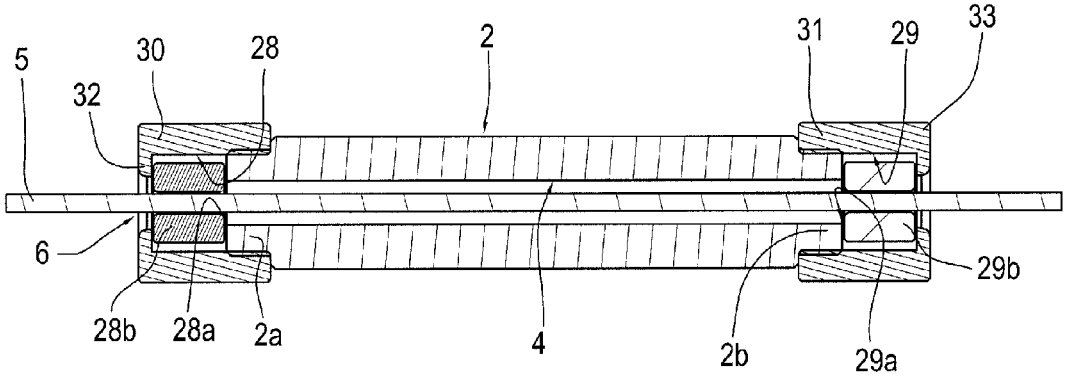
FIG. 5 is a cross-section of a fifth example embodiment of the grip element in accordance with the invention.

FIG. 5 shows a fifth example embodiment of the grip element in accordance with the invention. In FIG. 5, for convenience and easy understanding, the elements corresponding to those described in the previous example embodiments are labeled with the same reference characters.

In this fifth example embodiment the selective locking means 6 comprise at least a first end housing 28 in the handgrip 2, communicating with the through-channel 4 and having a first hole 28*a* for the passage of the cable 5 substantially coaxial with the channel 4. Engaged with suitable radial play in the end housing there is at least a first bushing 28*b* through which the cable 5 passes. After manual actions applied on the grip element 1 in any direction in space not coinciding with the axis of the cable 5, the first bushing 28*b* moves radially, so that it is out of line relative to the first hole 28*a* and locks the cable 5 between the first bushing 28*b* and the first hole 28*a*.

In more detail, to guarantee that the grip element 1 selective locking function works on both sides, the selective locking means 6 appropriately comprise a first end housing 28 and a second end housing 29, opposite each other, in the handgrip 2, the end housings communicating with the through-channel 4 and having respectively a first hole 28*a* and a second hole 29*a* for the passage of the cable 5, said holes being substantially coaxial with the through-channel 4, and communicating with the latter.

Inside the first end housing 28 and the second end housing 29 there respectively engage, with suitable radial play, a first bushing 28*b* and a second bushing 29*b* through which the cable 5 passes. The first bushing 28*b* and the second bushing 29*b* are designed to move radially, due to bending of the cable 5 as a result of a manual action on the grip element, thus moving out of line relative to the first hole 28*a* and relative to the second hole 29*a* and locking the cable 5 respectively between the first bushing 28*b* and the first hole 28*a* and between the second bushing 29*b* and the second hole 29*a*.

The first end housing 28 and the second end housing 29 are formed respectively by a first bush 30 and a second bush 31, rigidly connected (for example by threading) to the first end 2*a* and to the second end 2*b* of the handgrip 2, respectively forming a first pierced base 32 and a second pierced base 33 for the passage of the cable 5.

This example embodiment also has advantages relating to grip element maintenance during the life of the exercise machine, since there are no elastically deformable rubber components which are particularly prone to ageing, a phenomenon which would result in a gradual loss of the functional features of the grip element.

Figure 6:
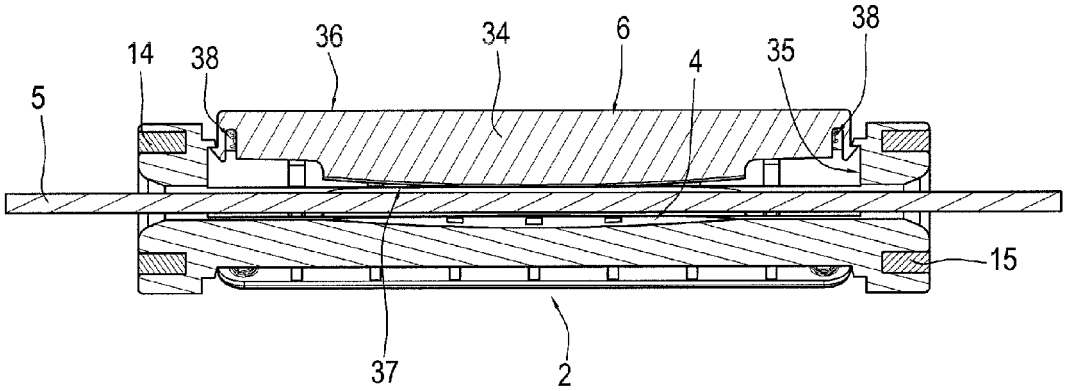
FIG. 6 is a cross-section of a sixth example embodiment of the grip element in accordance with the invention.

FIG. 6 shows a sixth example embodiment of the grip element in accordance with the invention. In FIG. 6, for convenience and easy understanding, the elements corresponding to those described in the previous example embodiments are labeled with the same reference characters.

In this sixth example embodiment the selective locking means 6 comprise at least one radial sector 34, engaged in a respective radial through-seat 35 made in the handgrip 2 and communicating with the channel 4, forming an outer manual action surface 36 and an inner shaped surface 37. The radial sector 34 can be moved manually, opposed by at least one return spring 38, from an inactive position in which the inner shaped surface 37 is retracted in the radial seat 35 and the cable 5 is free to slide in the through-channel 4, to a locking position in which the inner shaped surface 37 penetrates the through-channel 4, pressing the cable 5 against the channel 4 so as to prevent, by friction, cable sliding relative to the handgrip 2.

In more detail, to guarantee optimum grip element operation in any direction in space, the selective locking means 6 comprise a plurality of radial sectors 34 (for example three in number), engaging in respective radial through-seats 35 preferably spaced out in an equidistant fashion (at 120°), made in the handgrip 2 and communicating with the channel 4. The radial sectors 34 form respective outer manual action surfaces 36 and respective inner shaped surfaces 37. Each of the radial sectors 34 can be moved manually, opposed by a respective return spring 38, from an inactive position in which the inner shaped surface 37 is retracted in the radial seat 35 and the cable 5 is free to slide in the through-channel 4, to a locking position in which the inner shaped surface 37 penetrates the through-channel 4, pressing the cable 5 against the channel 4 so as to prevent, by friction, cable sliding relative to the handgrip 2.

This example embodiment has the advantage of allowing selective locking of the grip element 1 relative to the cable 5 even for manual actions applied by the user along the axis of the cable 5, that is to say, for manual actions which do not have components that are transversal to the cable.

The invention described above is susceptible of industrial application and may be modified and adapted in many other ways without thereby departing from the scope of the inventive concept. Moreover, all details of the invention may be substituted by technically equivalent elements without departing from the protective scope of the claims herein.

What is claimed is:

1. A grip element for an exercise machine, comprising at least a tubular handgrip (2), forming at least one outer surface (3) to be gripped by the user's hand while performing exercises to develop muscles or the like, and having at least one substantially longitudinal through-channel (4) in which there will engage at least one flexible cable (5) connected to at least one resistant load of at least one exercise machine, wherein the handgrip (2) comprises means (6) for selective locking of the grip element in any position along the cable (5), the locking means having at least one contact surface (7) of the through-channel (4) designed to adhere by friction to the outer surface of the cable (5), when the grip element is manually translated and/or rotated in any direction in space, to prevent the handgrip (2) from sliding relative to the cable (5), wherein the handgrip (2) has a first end (2*a*) and a second end (2*b*) which are elastically flexible and define a first portion (8) and a second portion (8') of said contact surface (7), respectively, said flexible ends of the handgrip being configured to bend with the cable (5), in order to generate adhesion of the first and second portions (8, 8') of the contact surface (7) to the outer surface of the cable (5), for locking the cable relative to the grip element when exercises are being performed, wherein said longitudinal through-channel (4) is completely surrounded by the tubular handgrip whereby a movement of the handgrip consisting of a translation, rotation-translation or rotation in any direction in space not coinciding with the axis of the cable causes an adhesion of said first flexible end portion (8) and/or said second flexible end portion (8') to the cable, and wherein the contact surface (7) is substantially located at least at one end opening of the through-channel (4).

2. The grip element according to claim 1, wherein the contact surface (7) comprises at least a first portion (8) and at least a second portion (8') located at the opposite end openings of the through-channel (4).

3. The grip element according to claim 2, wherein the through-channel (4) has a rigid middle segment (9) having a substantially cylindrical shape.

4. The grip element according to claim 3, wherein the rigid middle segment (9) is formed by at least one sleeve (10) rendered integral and coaxial with the handgrip (2).

5. The grip element according to claim 1, wherein the handgrip (2) comprises at least one cylindrical helical spring (26) and a portion of rigid tube (27), to be gripped by the user's hand, rendered integral in such a way that it is coaxial with the spring (26) substantially at the centre, the contact surface (7) being formed by the inner surface of the spring (26) and being designed, when the grip element is manually translated and/or rotated, to bend at the ends and to adhere by friction to the cable (5), preventing the cable from sliding relative to the handgrip (2).

6. The grip element according to claim 1, wherein the selective locking means (6) comprise at least a first end housing (28) of the handgrip (2), communicating with the through-channel (4) and having at least a first hole (28*a*) for the passage of the cable (5) substantially coaxial with the through-channel (4), in which there engages, with radial play, at least a first bushing (28*b*) through which the cable (5) passes, the first bushing (28*b*) being designed to translate radially, due to cable (5) bending as a result of a manual action on the grip element, thus moving out of line relative to the first hole (28*a*) and locking the cable (5) between the first bushing (28*b*) and the first hole (28*a*).

7. The grip element according to claim 6, wherein the selective locking means (6) comprise a first end housing (28) and a second end housing (29), opposite each other, of the handgrip (2), respectively having a first hole (28*a*) and a second hole (29*a*) for the passage of the cable (5), the holes being substantially coaxial with and communicating with the through-channel (4), inside the first end housing (28) and the second end housing (29) there engaging respectively, with radial play, a first bushing (28*b*) and a second bushing (29*b*) through which the cable (5) passes, said first bushing (28*b*) and second bushing (29*b*) being designed to translate radially, due to bending of the cable (5) as a result of a manual action on the grip element, thus respectively moving out of line with the first hole (28*a*) and the second hole (29*a*) and locking the cable (5) respectively between the first bushing (28*b*) and the first hole (28*a*) and between the second bushing (29*b*) and the second hole (29*a*).

8. The grip element according to claim 7, wherein the first end housing (28) and the second end housing (29) are respectively formed by a first bush (30) and by a second bush (31), rigidly connected to the first end (2*a*) and to the second end (2*b*) of the handgrip (2), respectively forming a first pierced base (32) and a second pierced base (33) for the passage of the cable (5).

9. The grip element according to claim 1, wherein the selective locking means (6) comprise at least one radial sector (34), engaged in a respective radial through-seat (35) made in the handgrip (2) and communicating with the channel (4), forming at least one outer manual action surface (36) and at least one inner shaped surface (37), said radial sector (34) being manually movable, opposed by at least one return spring (38), from an inactive position in which the inner shaped surface (37) is retracted in the radial seat (35) and the cable (5) can slide freely in the through-channel (4), to a locking position in which the inner shaped surface (37) penetrates the through-channel (4), pressing the cable (5) against the channel (4) to prevent, by friction, cable sliding relative to the handgrip (2).

10. The grip element according to claim 9, wherein the selective locking means (6) comprise a plurality of radial sectors (34), engaged in respective radial through-seats (35) made in the handgrip (2) and communicating with the channel (4), forming respective outer manual action surfaces (36) and respective inner shaped surfaces (37), each of the radial sectors (34) being manually movable, opposed by a respective return spring (38), from an inactive position in which the inner shaped surface (37) is retracted in the radial seat (35) and the cable (5) can slide freely in the through-channel (4), to a locking position in which the inner shaped surface (37) penetrates the through-channel (4), pressing the cable (5) against the channel (4) to prevent, by friction, cable sliding relative to the handgrip (2).

11. The grip element according to claim 1, wherein the handgrip (2) is made of substantially elastically flexible material, the handgrip (2) comprising a first end (2*a*) and a second end (2*b*) which are elastically flexible and at which there are a first portion (8) of the contact surface (7) and a second portion (8') of the contact surface (7).

12. The grip element according to claim 1, wherein the handgrip (2) is made of substantially elastically flexible material, the handgrip (2) comprising a first end (2*a*) and a second end (2*b*) which are elastically flexible and at which there are a first portion (8) of the contact surface (7) and a second portion (8') of the contact surface (7).

13. The grip element according to claim 2, wherein the handgrip (2) is made of substantially elastically flexible material, the handgrip (2) comprising a first end (2*a*) and a second end (2*b*) which are elastically flexible and at which there are the first portion (8) of the contact surface (7) and the second portion (8') of the contact surface (7).

14. The grip element according to claim 3, wherein the handgrip (2) is made of substantially elastically flexible material, the handgrip (2) comprising a first end (2*a*) and a second end (2*b*) which are elastically flexible and at which there are the first portion (8) of the contact surface (7) and the second portion (8') of the contact surface (7).

15. The grip element according to claim 4, wherein the handgrip (2) is made of substantially elastically flexible material, the handgrip (2) comprising a first end (2*a*) and a second end (2*b*) which are elastically flexible and at which there are the first portion (8) of the contact surface (7) and the second portion (8') of the contact surface (7).

* * * * *